US010589284B2

(12) United States Patent
Cook et al.

(10) Patent No.: US 10,589,284 B2
(45) Date of Patent: Mar. 17, 2020

(54) LOOSEFILL INSULATION BLOWING MACHINE WITH REMOTE CONTROL ASSEMBLY

(71) Applicant: Owens Corning Intellectual Capital, LLC, Toledo, OH (US)

(72) Inventors: David M. Cook, Granville, OH (US); Christopher M. Relyea, Columbus, OH (US); Brandon Robinson, Sylvania, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 1036 days.

(21) Appl. No.: 14/680,109

(22) Filed: Apr. 7, 2015

(65) Prior Publication Data

US 2016/0296940 A1 Oct. 13, 2016

(51) Int. Cl.

| | |
|---|---|
| ***B02C 25/00*** | (2006.01) |
| ***E04B 1/76*** | (2006.01) |
| ***E04F 21/12*** | (2006.01) |
| ***B02C 18/22*** | (2006.01) |
| ***E04F 21/08*** | (2006.01) |

(52) U.S. Cl.

CPC ..... *B02C 18/2216* (2013.01); *B02C 18/2291* (2013.01); *B02C 25/00* (2013.01); *E04B 1/76* (2013.01); *E04F 21/085* (2013.01); *E04F 21/12* (2013.01)

(58) Field of Classification Search

CPC ..... B02C 25/00; B02C 18/22; B02C 18/2208; B02C 18/2216; B02C 18/2225; B02C 18/2291; E04F 21/085

USPC ..... 241/18

See application file for complete search history.

(56) References Cited

U.S. PATENT DOCUMENTS

| | | | | | |
|---|---|---|---|---|---|
| 3,135,561 | A | | 6/1964 | Kempthorne | |
| 3,171,692 | A | | 3/1965 | Beery | |
| 3,995,775 | A | * | 12/1976 | Birkmeier | E04F 21/085 406/135 |
| 4,129,338 | A | * | 12/1978 | Mudgett | E04F 21/085 222/236 |
| 4,337,902 | A | * | 7/1982 | Markham | B02C 13/288 241/188.1 |

(Continued)

*Primary Examiner* — Shelley M Self
*Assistant Examiner* — Smith Oberto Bapthelus
(74) *Attorney, Agent, or Firm* — MacMillan, Sobanski & Todd, LLC

(57) ABSTRACT

A machine for distributing loosefill insulation from a package of compressed loosefill insulation material is provided. The machine includes a chute having an inlet end and an outlet end. The inlet end receives the loosefill insulation material. A shredding chamber is configured to receive the loosefill insulation material from the outlet end. The shredding chamber includes a plurality of shredders configured to shred, pick apart and condition the loosefill insulation material. A discharge mechanism is mounted to receive the conditioned material. The discharge mechanism is configured to distribute the conditioned material into an airstream. A blower is configured to provide the airstream flowing through the discharge mechanism. The blower has a rotational speed that defines the volume and the velocity of the airstream. A remote control assembly is configured to communicate with the machine such that the volume and velocity of the airstream can be adjusted in a remote location.

17 Claims, 6 Drawing Sheets

(56) References Cited

U.S. PATENT DOCUMENTS 4,528,489 A * 7/1985 Volk, Jr. ..... H02P 5/74 318/287
4,560,307 A 12/1985 Deitesfeld
5,114,281 A * 5/1992 Hartnett ..... E04F 21/085 222/617
5,556,237 A 9/1996 Rexius
5,590,984 A 1/1997 Assarsson
6,092,747 A 7/2000 Gerber et al.
7,125,204 B2 * 10/2006 Wysong ..... B60P 1/60 406/38
7,520,459 B2 * 4/2009 O'Leary ..... B65B 69/0008 100/215
7,731,115 B2 * 6/2010 Johnson ..... E04F 21/085 241/101.8
7,967,227 B2 * 6/2011 Johnson ..... E04F 21/085 241/101.8
7,971,813 B2 * 7/2011 O'Leary ..... B02C 18/2216 241/18
8,087,601 B2 * 1/2012 Johnson ..... E04F 21/085 241/236
8,245,960 B2 * 8/2012 Johnson ..... E04F 21/085 241/101.8
8,328,123 B2 * 12/2012 Evans ..... E04F 21/085 241/18
8,793,952 B2 * 8/2014 Olang ..... E04B 1/7604 428/309.9
9,004,382 B2 * 4/2015 Johnson ..... E04F 21/085 241/236
2007/0054639 A1 * 3/2007 Bauman ..... H04B 1/207 455/222
2008/0001773 A1 * 1/2008 Rye ..... G08C 17/00 340/4.31
2008/0003993 A1 * 1/2008 Rye ..... G08C 17/00 455/418
2008/0087752 A1 * 4/2008 Johnson ..... E04F 21/085 241/80
2008/0121782 A1 * 5/2008 Hotelling ..... G08C 23/04 250/208.1
2009/0009377 A1 * 1/2009 Chiu ..... G08C 17/02 341/176
2009/0244402 A1 * 10/2009 Rye ..... G08C 17/00 348/734
2010/0219273 A1 * 9/2010 Johnson ..... E04F 21/085 241/101.71
2010/0219274 A1 * 9/2010 Johnson ..... E04F 21/085 241/101.71
2011/0144820 A1 * 6/2011 Trauer ..... G08C 17/02 700/295
2011/0226881 A1 * 9/2011 Johnson ..... E04F 21/085 241/282.1
2012/0032012 A1 * 2/2012 Johnson ..... E04F 21/085 241/282.1
2015/0102143 A1 * 4/2015 Bynelius ..... B02C 4/12 241/28

* cited by examiner

LOOSEFILL INSULATION BLOWING MACHINE WITH REMOTE CONTROL ASSEMBLY

BACKGROUND

When insulating buildings and installations, a frequently used insulation product is loosefill insulation material. In contrast to the unitary or monolithic structure of insulation formed as batts or blankets, loosefill insulation material is a multiplicity of discrete, individual tufts, cubes, flakes or nodules. Loosefill insulation material is usually applied within buildings and installations by blowing the loosefill insulation material into an insulation cavity, such as a wall cavity or an attic of a building. Typically loosefill insulation material is made of glass fibers although other mineral fibers, organic fibers, and cellulose fibers can be used.

Loosefill insulation material, also referred to as blowing wool, is typically compressed in packages for transport from an insulation manufacturing site to a building that is to be insulated. Typically the packages include compressed loosefill insulation material encapsulated in a bag. The bags can be made of polypropylene or other suitable material. During the packaging of the loosefill insulation material, it is placed under compression for storage and transportation efficiencies. Typically, the loosefill insulation material is packaged with a compression ratio of at least about 10:1.

The distribution of loosefill insulation material into an insulation cavity typically uses an insulation blowing machine that feeds the loosefill insulation material pneumatically through a distribution hose. Insulation blowing machines typically have a large chute or hopper for containing and feeding the loosefill insulation material after the package is opened and the compressed loosefill insulation material is allowed to expand.

Insulation blowing machines can have in-machine controls that allow a machine user to adjust certain operating parameters of the blowing machine during use. It would be advantageous if insulation blowing machines could be improved to make them easier to use.

SUMMARY

The above objects as well as other objects not specifically enumerated are achieved by a machine for distributing loosefill insulation from a package of compressed loosefill insulation material. The machine includes a chute having an inlet end and an outlet end. The inlet end is configured to receive compressed loosefill insulation material. A shredding chamber is configured to receive the compressed loosefill insulation material from the outlet end of the chute. The shredding chamber includes a plurality of shredders configured to shred, pick apart and condition the loosefill insulation material thereby forming conditioned loosefill insulation material. A discharge mechanism is mounted to receive the conditioned loosefill insulation material exiting the shredding chamber. The discharge mechanism is configured to distribute the conditioned loosefill insulation material into an airstream. A blower is configured to provide the airstream flowing through the discharge mechanism. The blower has a rotational speed that defines the volume and the velocity of the airstream. A remote control assembly is configured to communicate with the machine such that the volume and velocity of the airstream can be adjusted in a location remote from the machine.

According to this invention there is also provided a remote control assembly for use with conditioned loosefill insulation material formed by a insulation blowing machine. The conditioned loosefill insulation material has a density. The remote control assembly includes an enclosure configured to provide a lightweight and durable housing. A control board is positioned within the enclosure and has a transmitter, associated circuitry and a power supply. The control board is configured to generate and transmit signals to the insulation blowing machine. One or more buttons is positioned to activate the control board such that a volume and velocity of an airstream produced by the insulation blowing machine can be adjusted from a location remote from the machine, thereby adjusting the density of the conditioned loosefill insulation material.

According to this invention there is also provided a method of distributing loosefill insulation material from a package of compressed loosefill insulation using a insulation blowing machine. The method includes the steps of shredding, picking apart and conditioning the loosefill insulation material to form conditioned loosefill insulation material, the conditioned loosefill insulation material having a density, distributing the conditioned loosefill insulation material in an airstream formed within a insulation blowing machine, the airstream having a volume and a velocity, and changing the volume and the velocity of the airstream from a location remote to the insulation blowing machine, such as to adjust the density of the conditioned loosefill insulation material.

Various objects and advantages of the loosefill insulation blowing machine with remote control density adjustment will become apparent to those skilled in the art from the following detailed description of the preferred embodiment, when read in light of the accompanying drawings.

DETAILED DESCRIPTION OF THE INVENTION

Figure 1:
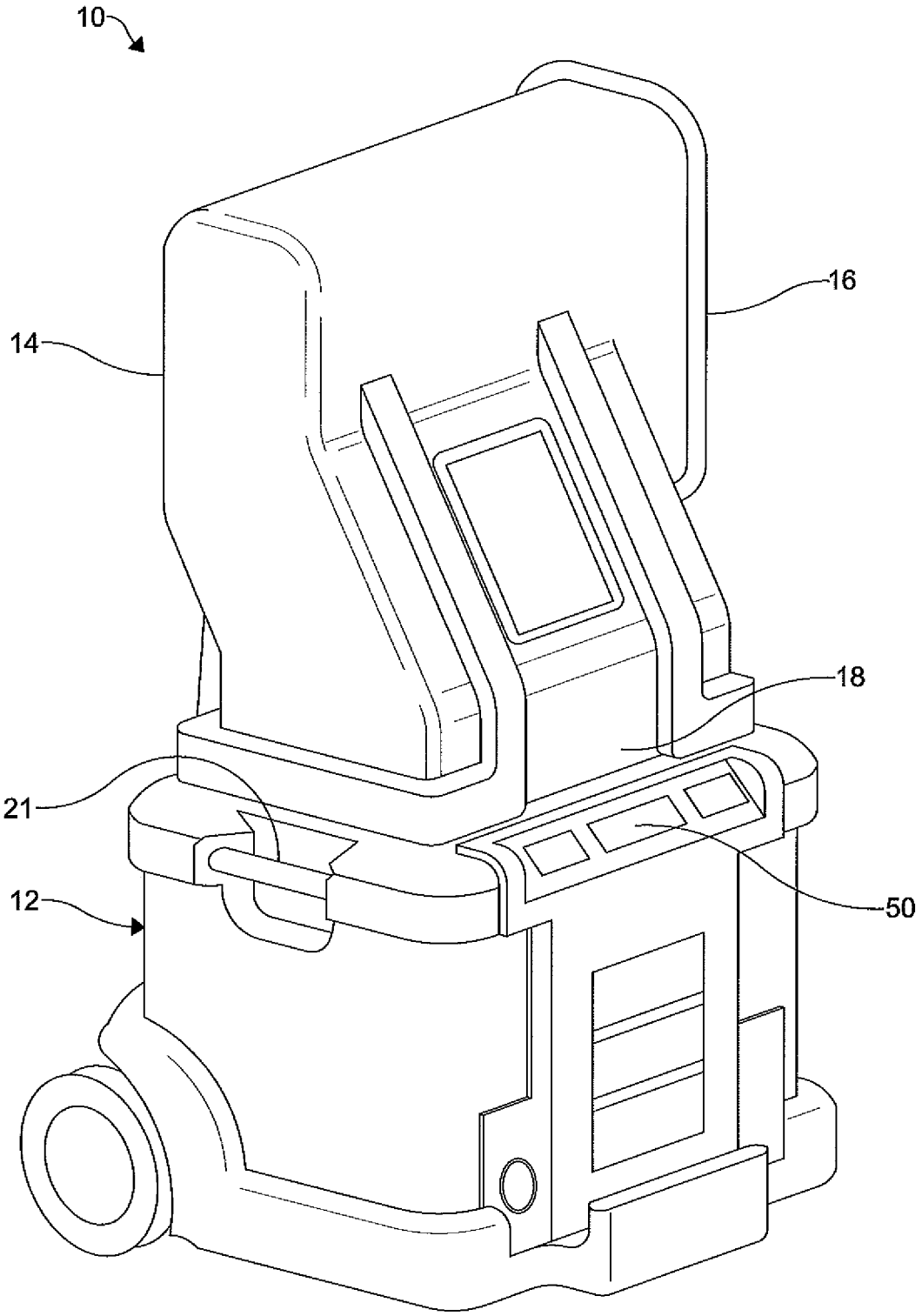
FIG. 1 is a front perspective view of an insulation blowing machine.
Figure 2:
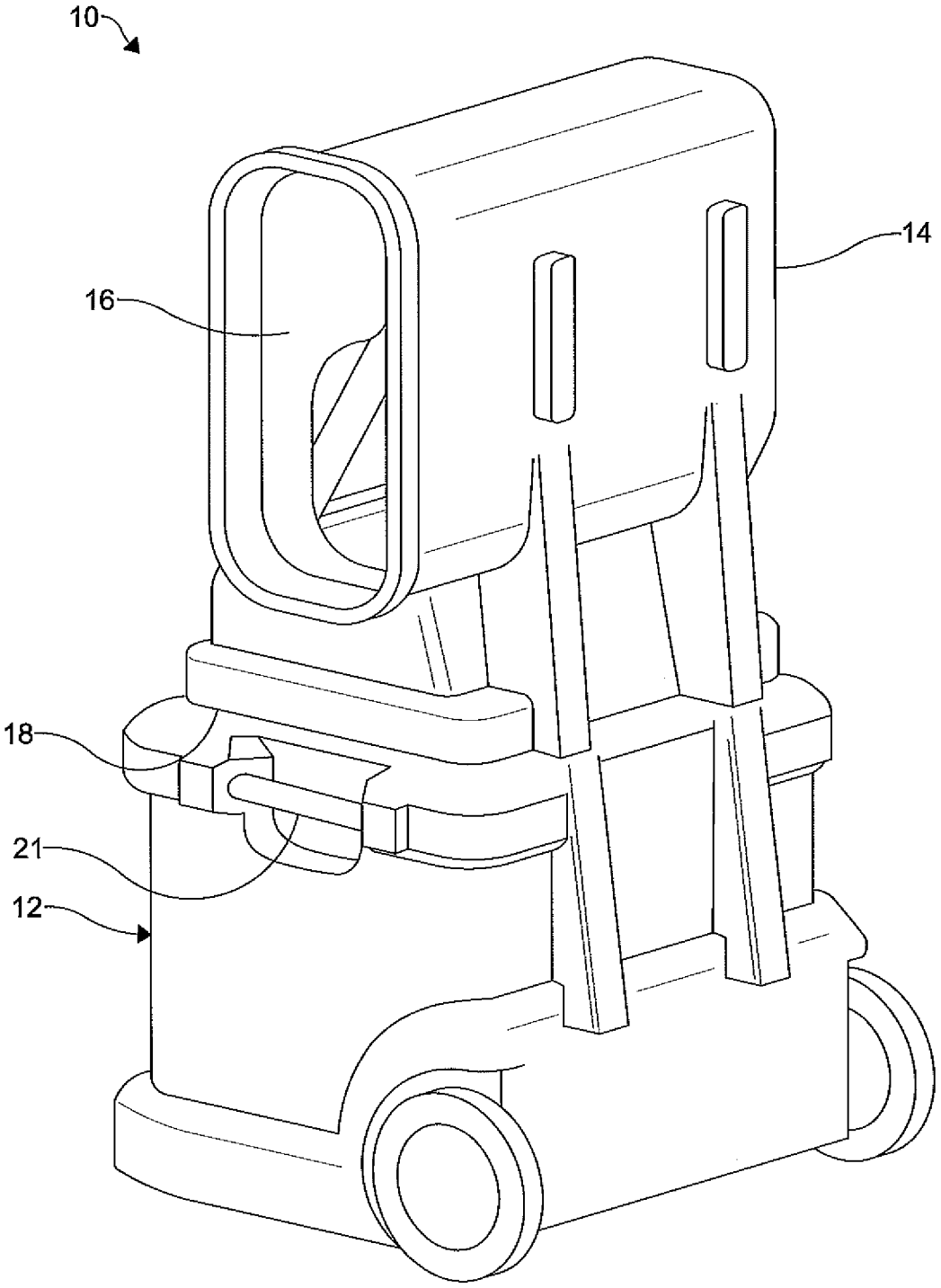
FIG. 2 is a rear perspective view of the insulation blowing machine of FIG. 1.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with illustrated embodiments of the present invention, the description and figures disclose a remote control assembly for a loosefill insulation blowing machine. Generally, the remote control assembly includes one or more controls for controlling certain operating characteristics of the blowing machine, including functions such as starting and stopping of motors positioned within the blowing machine. The remote control assembly also includes one or more controls for adjusting the density of the loosefill insulation material conditioned within the blowing machine and subsequently blown into an insulation cavity. In certain embodiments, the remote control assembly is configured to wirelessly communicate with controls positioned in the blowing machine.

The term "loosefill insulation", as used herein, is defined to mean any insulating materials configured for distribution in an airstream. The term "finely conditioned", as used herein, is defined to mean the shredding, picking apart and conditioning of loosefill insulation material to a desired density prior to distribution into an airstream. The term "remote control assembly", as used herein, is defined to mean any device or combination of devices, positioned apart from the blowing machine, configured to manage, command, direct and/or regulate certain operations of the blowing machine. The term "wirelessly", as used herein, is defined to mean communication over a distance without the use of electrical conductors or "wires".

Referring now to FIGS. 1-4, a loosefill insulation blowing machine (hereafter "blowing machine") is shown generally at 10. The blowing machine 10 is configured for conditioning compressed loosefill insulation material and further configured for distributing the conditioned loosefill insulation material to desired locations, such as for example, insulation cavities. The blowing machine 10 includes a lower unit 12 and a chute 14. The lower unit 12 is connected to the chute 14 by one or more fastening mechanisms (not shown) configured to readily assemble and disassemble the chute 14 to the lower unit 12. The chute 14 has an inlet end 16 and an outlet end 18.

Referring again to FIGS. 1-4, the inlet end 16 of the chute 14 is configured to receive compressed loosefill insulation material. The compressed loosefill insulation material is guided within the interior of the chute 14 to the outlet end 18, wherein the loosefill insulation material is introduced to a shredding chamber 23 as shown in FIG. 3.

Referring again to FIGS. 1, 2 and 4, optionally the lower unit 12 can include one or more handle segments 21, configured to facilitate ready movement of the blowing machine 10 from one location to another. However, it should be understood that the one or more handle segments 21 are not necessary to the operation of the blowing machine 10.

Referring again to FIGS. 1-4, the chute 14 can include an optional bail guide (not shown for purposes of clarity) mounted at the inlet end 16 of the chute 14. The bail guide is configured to urge a package of compressed loosefill insulation material against an optional cutting mechanism (also not shown for purposes of clarity) as the package of compressed loosefill insulation material moves further into the chute 14. The bail guide and the cutting mechanism can have any desired structure and operation.

Figure 3:
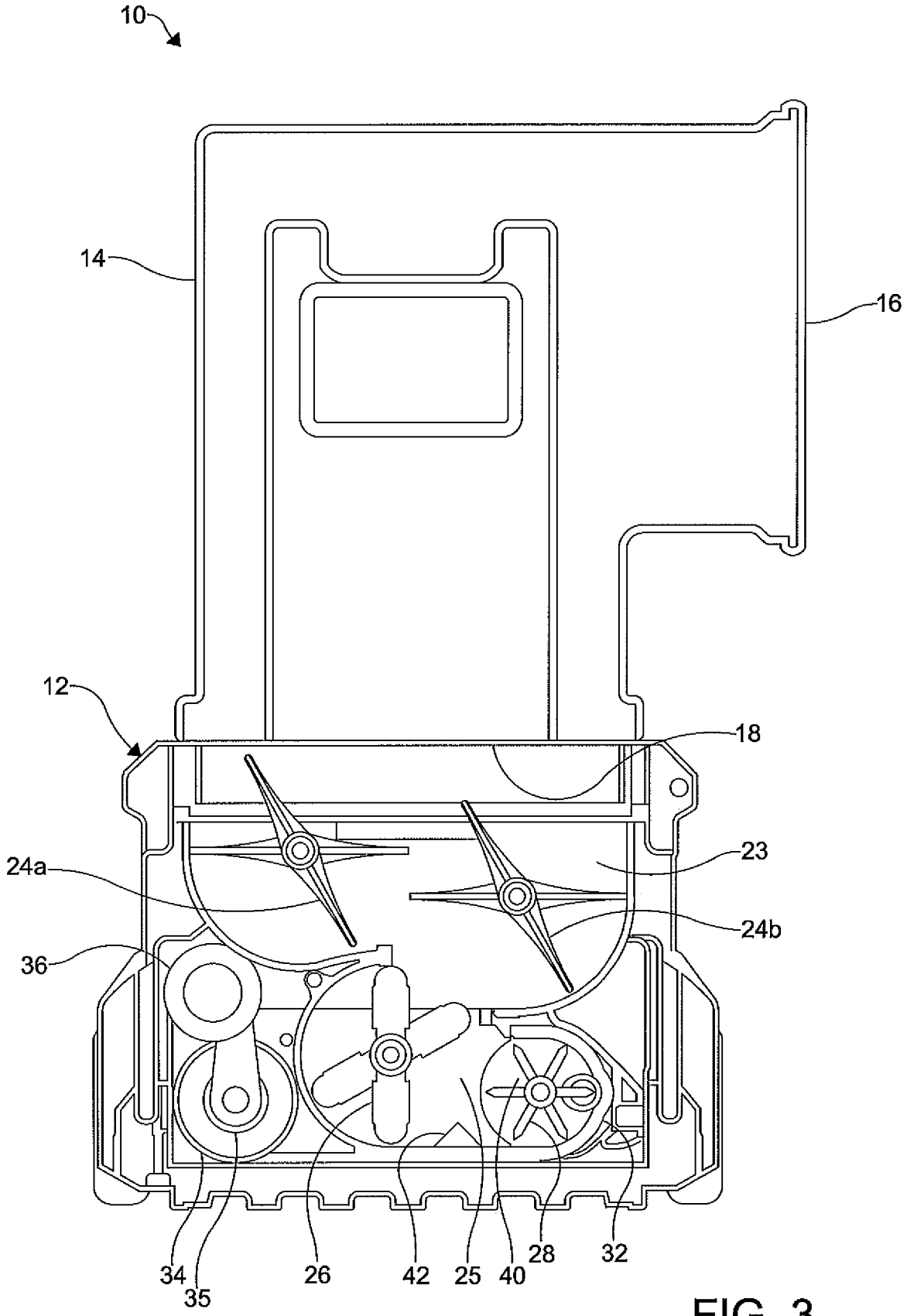
FIG. 3 is a front elevational view, partially in cross-section, of the insulation blowing machine of FIG. 1.

Referring now to FIG. 3, the shredding chamber 23 is mounted at the outlet end 18 of the chute 14. The shredding chamber 23 includes one or more low speed shredders 24*a*, 24*b* and one or more agitators 26. The low speed shredders 24*a*, 24*b* are configured to shred, pick apart and condition the loosefill insulation material as the loosefill insulation material is discharged into the shredding chamber 23 from the outlet end 18 of the chute 14. The agitator 26 is configured to finely condition the loosefill insulation material to a desired density as the loosefill insulation material exits the low speed shredders 24*a*, 24*b*. It should be appreciated that although a quantity of two low speed shredders 24*a*, 24*b* and a lone agitator 26 are illustrated, any desired quantity of low speed shredders 24*a*, 24*b* and agitators 26 can be used. Further, although the blowing machine 10 is shown with low speed shredders 24*a*, 24*b*, any type of separator, such as a clump breaker, beater bar or any other mechanism, device or structure that shreds, picks apart and conditions the loosefill insulation material can be used.

Referring again to FIG. 3, the agitator 26 is configured to finely condition the loosefill insulation material, thereby forming finely conditioned loosefill insulation material and preparing the finely conditioned loosefill insulation material for distribution into an airstream. In the embodiment illustrated in FIG. 3, the agitator 26 is positioned vertically below the one or more low speed shredders 24*a*, 24*b*. Alternatively, the agitator 26 can be positioned in any desired location relative to the one or more low speed shredders 24*a*, 24*b*, sufficient to receive the loosefill insulation material from the one or more low speed shredders 24*a*, 24*b*, including the non-limiting example of being positioned horizontally adjacent to the low speed shredders 24*a*, 24*b*. In the illustrated embodiment, the agitator 26 is a high speed shredder. Alternatively, the agitator 26 can be any type of shredder, such as a low speed shredder, clump breaker, beater bar or any other mechanism that finely conditions the loosefill insulation material and prepares the finely conditioned loosefill insulation material for distribution into an airstream.

In the embodiment illustrated in FIG. 3, the low speed shredders 24*a*, 24*b* rotate at a lower rotational speed than the rotational speed of the agitator 26. The low speed shredders 24*a*, 24*b* rotate at a rotational speed of about 40-80 rpm and the agitator 26 rotates at a rotational speed of about 300-500 rpm. In other embodiments, the low speed shredders 24*a*, 24*b* can rotate at rotational speeds less than or more than 40-80 rpm and the agitator 26 can rotate at rotational speeds less than or more than 300-500 rpm. In still other embodiments, the low speed shredders 24*a*, 24*b* can rotate at rotational speeds different from each other.

Referring again to FIG. 3, a discharge mechanism 28 is positioned adjacent to the agitator 26 and is configured to distribute the finely conditioned loosefill insulation material exiting the agitator 26 into an airstream. The finely conditioned loosefill insulation material is driven through the discharge mechanism 28 and through a machine outlet 32 by an airstream provided by a blower 34 and associated ductwork (not shown) mounted in the lower unit 12. The blower 34 is mounted for rotation and is driven by a blower motor 35. The airstream is indicated by an arrow 33 in FIG. 4. In other embodiments, the airstream 33 can be provided by other methods, such as by a vacuum, sufficient to provide an airstream 33 driven through the discharge mechanism 28.

Referring again to FIG. 3, the shredders 24, agitator 26 and discharge mechanism 28 are mounted for rotation. They can be driven by any suitable means, such as by an electric motor 36, or other means sufficient to drive rotary equipment. Alternatively, each of the shredders 24, agitator 26 and discharge mechanism 28 can be provided with its own source of rotation.

Referring again to FIG. 1, the blowing machine 10 includes a control panel 50. The control panel 50 includes a plurality of control devices configured to direct certain operating characteristics of the blowing machine 10, including functions such as starting and stopping of the motors 35, 36 and adjustment of the density of the conditioned blowing insulation material.

Figure 4:
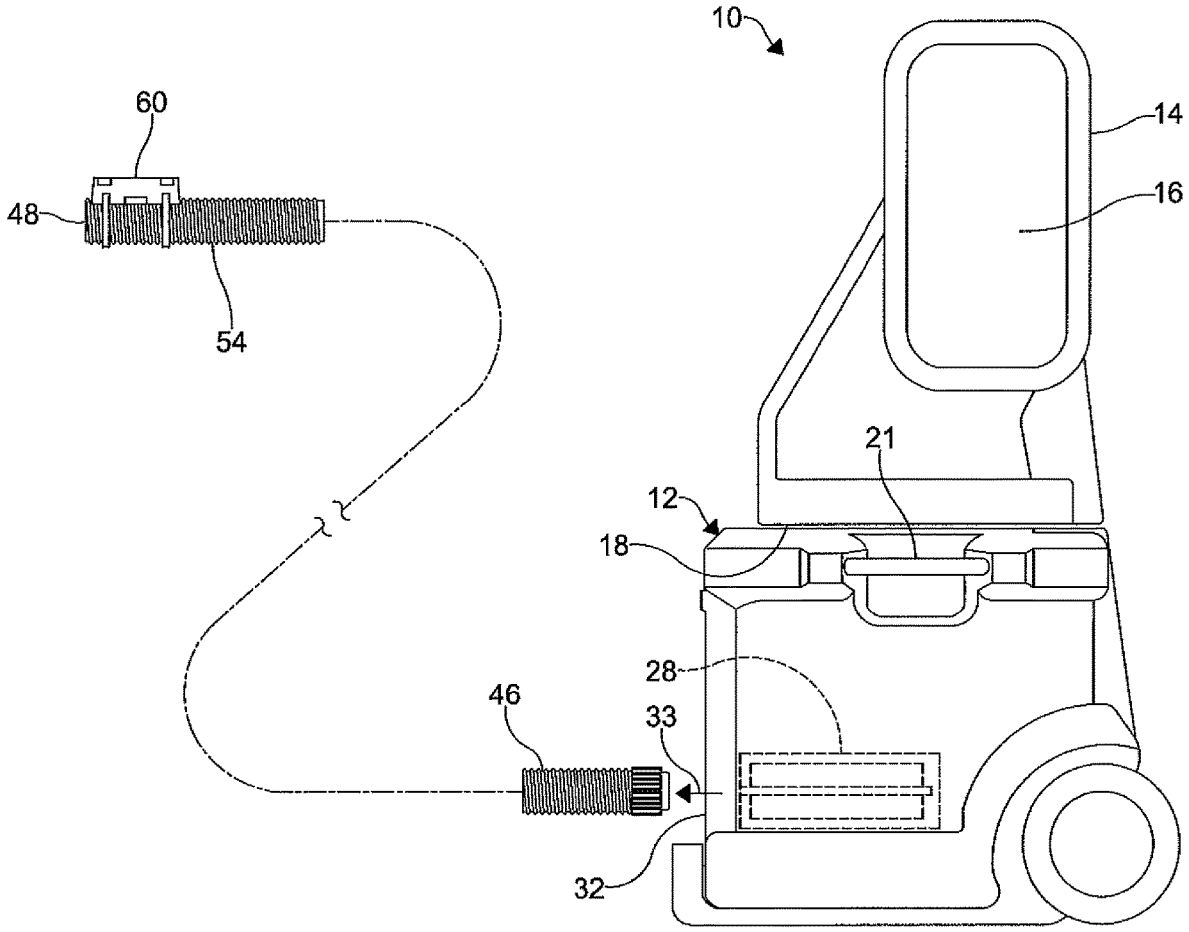
FIG. 4 is a side elevational view of the insulation blowing machine of FIG. 1, illustrating a distribution hose equipped with a remote control assembly.

Referring again to FIGS. 1-4, in operation, the chute 14 guides the loosefill insulation material to the shredding chamber 23. The shredding chamber 23 includes the low speed shredders 24*a*, 24*b*, configured to shred, pick apart and condition the loosefill insulation material. The shredded loosefill insulation material drops from the low speed shredders 24*a*, 24*b* into the agitator 26. The agitator 26 finely conditions the loosefill insulation material and prepares the loosefill insulation material for distribution into the airstream 33 by further shredding and conditioning the loosefill insulation material. The finely conditioned loosefill insulation material exits the agitator 26 at an outlet end 25 of the shredding chamber 23 and enters the discharge mechanism 28 for distribution into the airstream 33 provided by the blower 34. The airstream 33, with the finely conditioned loosefill insulation material, exits the insulation blowing machine 10 at the machine outlet 32 and flows through a distribution hose 46, as shown in FIG. 4, toward an insulation cavity, not shown.

Referring again to FIG. 3, the discharge mechanism 28 has a side inlet 40 and an optional choke 42. The side inlet 40 is configured to receive the finely conditioned blowing insulation material as it is fed from the agitator 26. In this embodiment, the agitator 26 is positioned to be adjacent to the side inlet 40 of the discharge mechanism 28. In embodiments, one or more low speed shredders 24*a*, 24*b* or agitators 26, or other shredding mechanisms can be positioned adjacent to the side inlet 40 of the discharge mechanism 28 or in other suitable positions.

Referring again to FIG. 3, the optional choke 42 is configured to partially obstruct the side inlet 40 of the discharge mechanism 28 such that heavier clumps of blowing insulation material are prevented from entering the side inlet 40 of the discharge mechanism 28. The heavier clumps of blowing insulation material are redirected past the side inlet 40 of the discharge mechanism 28 to the low speed shredders 24*a*, 24*b* for recycling and further conditioning.

Referring again to FIG. 4, the distribution hose 46 has a cavity end 54. In the illustrated embodiment, the cavity end 54 of the distribution hose 46 does not include a nozzle. Accordingly, the finely conditioned loosefill insulation material exits the distribution hose 46 through an outlet end 48. However, it should be appreciated that in other embodiments, a nozzle can be positioned at the outlet end 48 of the distribution hose 46. The nozzle can be configured to distribute the finely conditioned loosefill insulation material flowing through the distribution hose 46 into an insulation cavity (not shown). The nozzle can have any desired shape, size and structure.

Referring again to FIG. 4, a remote control assembly 60 is removably attached to the cavity end 54 of the distribution hose 46. The remote control assembly 60 is configured to wirelessly communicate with the machine control panel 50 and further configured to remotely control certain operating characterisitics of the blowing machine 10, including functions such as starting and stopping of the motors 35, 36 and adjustment of the density of the conditioned blowing insulation material.

Figure 5:
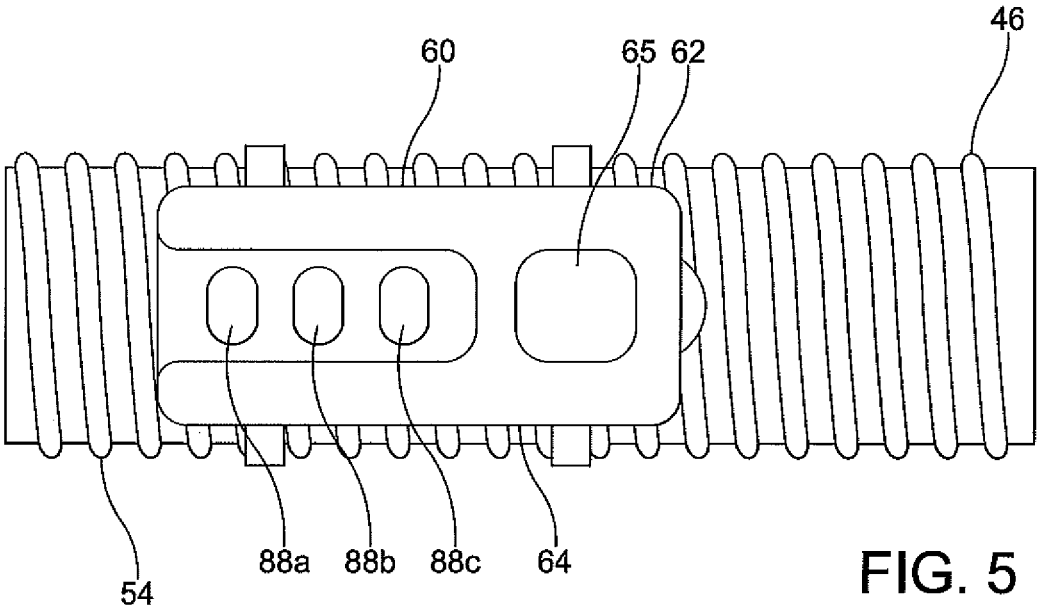
FIG. 5 is a perspective view of a portion of the distribution hose and the remote control assembly of FIG. 4.
Figure 6:
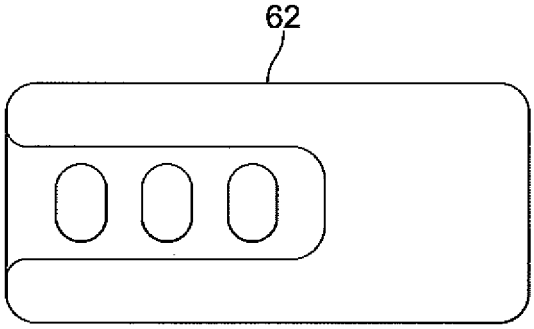
FIG. 6 is a perspective view of the remote control assembly of FIG. 5 showing a remote control module apart from a mounting fixture.
Figure 6:
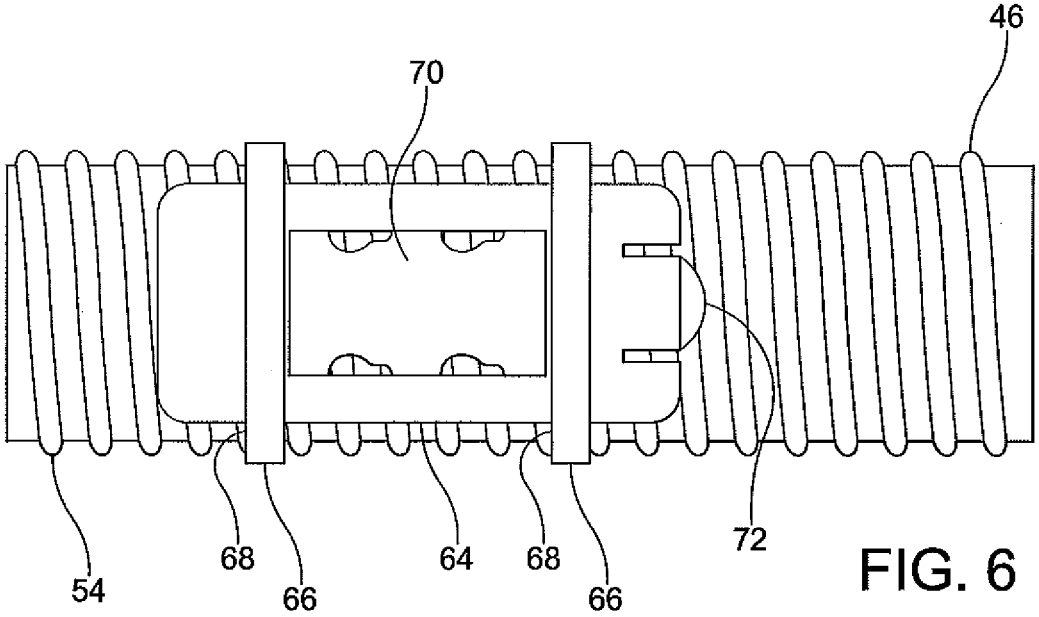

Referring now to FIGS. 5 and 6, one embodiment of the remote control assembly 60 is illustrated. The remote control assembly 60 includes a module 62 removably connected to a mounting fixture 64. As will be explained in more detail below, the module 62 includes mechanisms and controls configured for communication with the machine control panel 50 and further configured to activate the starting, stopping and density control functions of the machine control panel 50.

Referring now to FIG. 5, the remote control assembly 60 includes optional indicia 65. The optional indicia 65 can include any desired message, symbol or graphical indication. Non-limiting examples of the indicia 65 include instructions for operating the blowing machine 10, safety instructions, advertising messages, branding symbols and company logos. The optional indicia 65 can be positioned on the enclosure module 62 in any desired manner, including the non-limiting examples of printing on the enclosure and using stickers.

Referring now to FIG. 6, the mounting fixture 64 is removable connected to the cavity end 54 of the distribution hose 46 by a plurality of straps 66. The straps 66 are configured to circumferentially engage the distribution hose 46. In the illustrated embodiment, the straps 66 have the form of a cable-tie or zip-tie, with a plurality of teeth for releaseably engaging a pawl. However, the straps 66 can have other forms and structures sufficient to removably connect the mounting fixture 64 to the hose 46. While the embodiment illustrated in FIGS. 5 and 6 show a quantity of two straps 66, it should be appreciated that in other embodiments, more than or less than two straps 66 can be used.

Referring again to FIG. 6, the mounting fixture 64 includes a plurality of guides 68 configured for locating the straps 66 and a surface 70 configured to receive the module 62. The guides 68 can have any desired structure or configuration sufficient to locate the straps 66. The surface 70 is configured to receive and mate with a corresponding rear surface (not shown) of the module 62. The module 62 is releaseably secured to the mounting fixture 64 via an attachment device 72. In the illustrated embodiment, the attachment device 72 is a snap tab. However, in other embodiments, the attachment device 72 can be other devices, mechanisms or structures sufficient to releaseably secure the module 62 to the mounting fixture 64.

Figure 7:
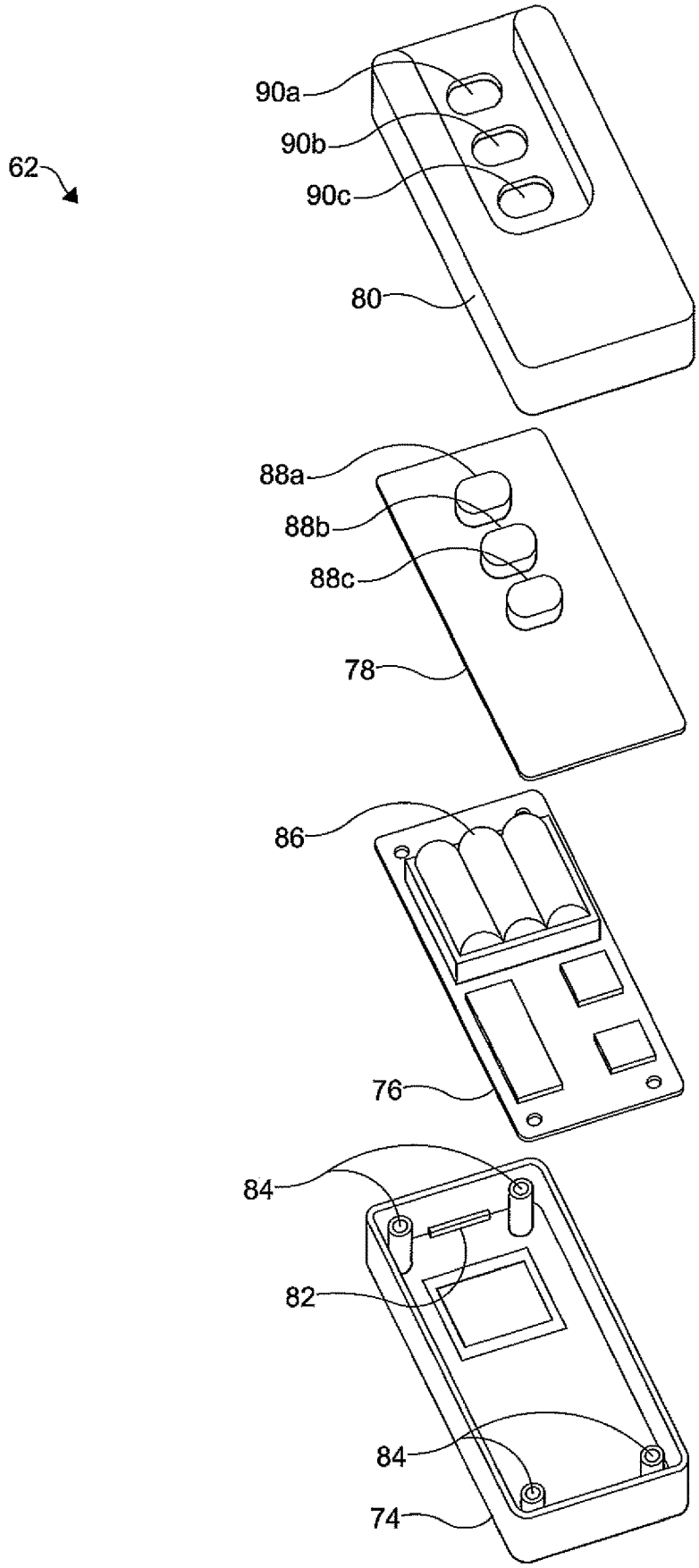
FIG. 7 is an exploded perspective view of the remote control module of FIG. 6.

Referring now to FIG. 7, an exploded view of the module 62 is illustrated. The module 62 includes an enclosure 74, one or more control boards 76, a button panel 78 and a cover 80. The enclosure 74 is configured to be a lightweight and durable housing for the components associated with the module 62. In the illustrated embodiment, the enclosure 74 is made from a thermoplastic polymer material, such as for example polyethylene. In other embodiments, the enclosure 74 can be made from other desired materials, such as for example polypropylene, sufficient to be a lightweight and durable housing for the components associated with the module 62.

The enclosure 74 includes one or more cavities 82 configured to receive the attachment device 72, such that the enclosure 74 is releaseably secured to the mounting fixture 64. The enclosure 74 further includes one or more mounting bosses 84 configured to receive the one or more control boards 76. The control boards 76 can be attached to the mounting bosses 84 in any desired many, including the non-limiting examples of screws, clips or clamps (not shown).

Referring again to FIG. 7, the control board 76 includes an antenna, a transmitter and circuitry associated with directing certain operating characteristics of the blowing machine 10. Optionally, the control board 76 can include a power supply 86. In the illustrated embodiment, the power supply 86 is in the form of one or more batteries. However, in other embodiments, the power supply can have other forms, such as for example, photovoltaic modules. The control board 76 is configured to perform several functions. First, the control board 76 is configured to generate signals for directing certain operating characteristics of the blowing machine 10. Second, the control board 76 is configured to wirelessly transmit the generated signals to the machine control panel 50.

Referring again to FIG. 7, the button panel 78 is positioned atop the control panel 76 and includes a first button 88*a*, a second button 88*b* and a third button 88*c*. The button panel 78 is configured to provide a protective and durable covering for the buttons 88*a*-88*c* and the control panel 76. In the illustrated embodiment, button panel 78 is formed from an elastomeric material, such as the non-limiting example of polyurethane. In other embodiments, the button panel 78 can be formed from other materials, such as for example polyvinylchloride.

Referring again to FIG. 7, the first, second and third buttons 88*a*-88*c* are configured to activate signal generating circuitry positioned in the control board 76. In the illustrated embodiment, a quantity of three buttons are used, each formed in a different color to differentiate the functions directed. In alternative embodiments, any desired quantity of buttons can be provided and the buttons can be differentiated from each other in different manners, including the non-limiting example of tactile indicators.

Referring again to FIG. 7, the cover 80 sits atop the enclosure 82 such that a first aperture 90*a* aligns with the first button 88*a*, a second aperture 89*b* aligns with the second button 88*b* and a third aperture 90*c* aligns with the third button 88*c*. As shown in FIG. 5, in an assembled condition, the first, second and third buttons 88*a*-88*c* extend through the first, second and third apertures 90*a*-90*c* in the cover 80, such as to facilitate use of the first, second and third buttons 88*a*-88*c*. In the illustrated embodiment, the cover 80 attaches to the enclosure 82 with a snap fit. However, in other embodiments, the cover 80 can be attached to the enclosure 82 through other structures, mechanisms and devices.

Referring again to FIG. 5, the assembled remote control assembly 60 is illustrated. The first, second and third buttons 88*a*-88*c* extend through the first, second and third apertures 90*a*-90*c* in the cover 80 and the control board 76 is positioned within the enclosure 74. The control board 76 includes the power supply 86. The remote control assembly 60 is removably attached to the cavity end 54 of the distribution hose 46 as discussed above.

Referring again to FIG. 5, in operation, the machine user remotely directs operation of the blowing machine 10 using the remote control assembly 60 through the following steps. The machine user activates the shredder and agitator motor 36 via the control panel 50. Now positioned in a location remote from the blowing machine 10, the machine user depresses the first button 88*a* of the remote control assembly 60. The first button 88*a* actuates the circuitry on the control board 76 to generate and transmit a signal to the control panel 50 on the blowing machine 10 (as shown in FIG. 1). The signal is received by the control panel 50 and the control panel 50 actuates operation of the blower 34.

Referring again to FIG. 5, the transmitter is a frequency modulated transmitter, that is, the transmitter is configured to generate and transmit signals via radio waves using frequency modulated broadcast bands. In the illustrated embodiment, the signals are broadcast in a frequency spectrum in a range of from about 30.0 MHz to about 400.0 MHz. However, in other embodiments, the signals can be broadcast in a modulated frequency of less than about 30.0 MHz or more than about 400.0 MHz. Use of a frequency modulated broadcast band provides the benefit of substantially overcoming electromagnetic interference (EMI). By substantially overcoming electromagnetic interference, the remote control assembly 60 is able to direct certain operating characteristics of the blowing machine 10 without substantial interruption, obstruction, degradation or limitation of the transmitted signals up to a range of about 250 feet.

Activating the blower 34 via the first button 88*a* results in the blower 34 operating in a "full-on" mode. That is, the blower 34 is configured to provide an airstream 33 with a high volume and a high velocity. The high volume and high velocity of the airstream 33 results in the blown loosefill insulation material having a low density when installed in an insulation cavity. As one example, the full-on mode can result in an installed density in a range of from about 0.40 pounds per cubic foot to about 0.60 pounds per cubic foot. The full-on mode is configured for effectively insulating typical open insulation cavities, such as for example, an attic expanse. The full-on operating mod; initiated by depression of the first button 88*a* of the remote control assembly 60, can be stopped by depression of the second button 88*b* of the remote control assembly 60. Depression of the second button 88*b* instructs the blower 34 to cease the airstream 33.

Referring again to FIG. 5, the blower 34 can achieve another operating mode by depression of the third button 88*c* of the remote control assembly 60. In this mode, the blower 34 operates at a lower rotational speed, thereby providing an airstream 33 having less volume and a slower velocity. Since the airstream 33 has less volume and a slower velocity, the resulting density of the blown loosefill insulation material is higher than that achieved when the blower 34 is operating at the full-on mode. As one non-limiting example, in the alternate mode the blower 34 can operate at 40.0% of the rotational speed of the full-on mode. The resulting density of the blown loosefill insulation material is then in a range of from about 0.60 pounds per cubic foot to about 1.00 pounds per cubic foot. The increased density of the blown loosefill insulation material can be advantageously used for insulating difficult to reach areas, such as for example eaves and around obstructions. Since the density of the blown loosefill insulation material is higher around the difficult to reach areas, the resulting insulative value (R-value) of the blown loosefill insulation material in these areas is correspondingly higher. Used in this manner, the remote control assembly 60 advantageously provides the machine user with the ability to adjust the density of the blown loosefill insulation while operating remote from the blowing machine 10.

Referring again to FIG. 5, yet another operating mode can be achieved by simultaneous depression of two buttons, either the first and second buttons 88*a*, 88*b*, the first and third buttons 88*a*, 88*c* or the second and third buttons 88*b*, 88*c*. In this "air-only" mode, the blower 34 within the blowing machine 10 is configured to operate in the "full-on" mode, however the flow of loosefill insulation material to the discharge mechanism is stopped, thereby resulting in a flow of the airstream 33 without the conditioned loosefill insulation material, that is, the airstream 33 is devoid of conditioned loosefill insulation material. The resulting high volume and high velocity of the airstream 33 can be advantageously used to level and redistribute previously blown loosefill insulation material within an insulation cavity. While this mode has been described as operating in the full-on mode, it is within the contemplation of this invention that the "air only" mode can be accomplished at any desired rotational speed of the blower 34.

The principle and mode of operation of the loosefill insulation blowing machine having a remote control assembly have been described in certain embodiments. However, it should be noted that the loosefill insulation blowing machine having a remote control assembly may be practiced otherwise than as specifically illustrated and described without departing from its scope.

What is claimed is:

1. A machine for distributing loosefill insulation from a package of compressed loosefill insulation material, the machine comprising:

a chute having an inlet end and an outlet end, the inlet end configured to receive compressed loosefill insulation material;

a shredding chamber configured to receive the compressed loosefill insulation material from the outlet end of the chute, the shredding chamber including a plurality of shredders configured to shred and pick apart the loosefill insulation material, the plurality of shredders being driven by an electric motor having a rotation speed;

a discharge mechanism mounted to receive the loosefill insulation material exiting the shredding chamber, the discharge mechanism configured to distribute the loosefill insulation material into an airstream;

a blower configured to provide the airstream flowing through the discharge mechanism, the blower being driven by a blower motor that is distinct from the electric motor, the blower have a rotational speed that defines the volume and the velocity of the airstream; and a remote control assembly configured to communicate with the machine such that the density of the loosefill insulation material is adjusted in a location remote from the machine by adjusting the rotational speed of the electric motor driving the plurality of shredders and the blower motor driving the blower.

2. The machine of claim 1, wherein remote adjustment of the volume and velocity of the airstream is accomplished by reducing the rotational speed of the blower.

3. The machine of claim 1, wherein the loosefill insulation material, prior to remote adjustment of the volume and velocity of the airstream, has a density in a range of from about 0.40 pounds per cubic foot to about 0.60 pounds per cubic foot.

4. The machine of claim 1, wherein the loosefill insulation material, following adjustment of the volume and velocity of the airstream, has a density in a range of from about 0.60 pounds per cubic foot to about 1.00 pounds per cubic foot.

5. The machine of claim 4, wherein following adjustment of the volume and velocity of the airstream, the rotational speed of the blower is 40% of the rotational speed of the blower prior to adjustment of the volume and velocity of the airstream.

6. The machine of claim 1, wherein the remote control assembly includes a button dedicated to adjust the density of the loosefill insulation material.

7. The machine of claim 1, wherein the remote control assembly is configured to communicate with the machine to provide an airstream devoid of loosefill insulation material.

8. The machine of claim 1, wherein the remote control assembly is configured to communicate with the machine using wireless signals.

9. The machine of claim 8, wherein the wireless signals are configured using frequency modulated broadcast bands.

10. The machine of claim 9, wherein the frequency modulated broadcast bands are in a range of from about 30.0 MHZ to about 400 MHZ.

11. The machine of claim 1, wherein the remote control assembly is configured to communicate with the machine for a distance of up to 250.0 feet.

12. The machine of claim 1, wherein the remote control assembly includes a module connected to a mounting fixture.

13. The machine of claim 12, wherein the module is releaseably secured to the mounting fixture.

14. The machine of claim 12, wherein the module, apart from the mounting fixture, is configured to communicate with the machine such that the volume and velocity of the airstream is accomplished by reducing the rotational speed of the blower.

15. The machine of claim 1, wherein the remote control assembly is configured to control at least three distinct operating modes of the machine.

16. The machine of claim 15, wherein one of the operating modes is an air-only mode.

17. The machine of claim 15, wherein one of the operating modes is configured to provide an airstream to level and redistribute previously blown insulation material.

* * * * *